US008890430B2

(12) United States Patent
Guo et al.

(10) Patent No.: US 8,890,430 B2
(45) Date of Patent: Nov. 18, 2014

(54) DIELECTRIC-FREE TRIODE FIELD EMISSION DISPLAY DEVICE BASED ON DOUBLE-GATE/SINGLE-CATHODE TYPE ELECTRON EMISSION UNITS AND THE DEVICE DRIVE METHODS

(76) Inventors: Tailiang Guo, Fujian (CN); Jianmin Yao, Fujian (CN); Zhixian Lin, Fujian (CN); Yun Ye, Fujian (CN); Zhilong Chen, Fujian (CN); Yongai Zhang, Fujian (CN); Sheng Xu, Fujian (CN); Liqin Hu, Fujian (CN)

( * ) Notice: Subject to any disclaimer, the term of this patent is extended or adjusted under 35 U.S.C. 154(b) by 0 days.

(21) Appl. No.: 13/577,294

(22) PCT Filed: Jul. 15, 2011

(86) PCT No.: PCT/CN2011/077212

§ 371 (c)(1),
(2), (4) Date: Aug. 6, 2012

(87) PCT Pub. No.: WO2012/068888

PCT Pub. Date: May 31, 2012

(65) Prior Publication Data

US 2013/0241434 A1 Sep. 19, 2013

(51) Int. Cl.

| | |
|---|---|
| ***H01J 21/10*** | (2006.01) |
| ***H01J 19/38*** | (2006.01) |
| ***G09G 3/22*** | (2006.01) |
| ***H01J 29/48*** | (2006.01) |
| ***H01J 31/12*** | (2006.01) |

(52) U.S. Cl.

CPC . *H01J 21/10* (2013.01); *G09G 3/22* (2013.01); *H01J 29/481* (2013.01); *H01J 31/127* (2013.01); *H01J 19/38* (2013.01); *G09G 2230/00* (2013.01)

USPC ..... 315/260; 315/337; 313/497

(58) Field of Classification Search

None

See application file for complete search history.

(56) References Cited

U.S. PATENT DOCUMENTS

| | | | | |
|---|---|---|---|---|
| 6,242,865 | B1 * | 6/2001 | Zimlich | 315/169.3 |
| 2007/0164657 | A1 * | 7/2007 | Lee et al. | 313/497 |
| 2010/0252804 | A1 * | 10/2010 | Cheng et al. | 257/10 |
| 2010/0264805 | A1 * | 10/2010 | Fennimore et al. | 313/308 |
| 2013/0015778 | A1 * | 1/2013 | Li et al. | 315/246 |
| 2013/0026906 | A1 * | 1/2013 | Guo et al. | 313/496 |
| 2014/0111083 | A1 * | 4/2014 | Guo et al. | 313/497 |

* cited by examiner

*Primary Examiner* — Jany Richardson

(57) ABSTRACT

The present invention relates to display manufacturing technology, especially for a dielectric-free triode field emission display device based on double-gate/single-cathode type electron emission units and the device drive methods. This device comprises parallelly positioned anode and cathode/gate plates, during production, gate/cathode/gate electron emission units are set on the cathode/gate plate side by side. The spacing between cathode and gate electrodes is vacuum circumstance. For each cathode, an anode is positioned on the anode plate, facing the cathode. And the voltages applied on the cathode and gate electrodes are to scan and the anode voltage is to adjust the signal. When the electrodes on the cathode/gate plate take on fixed roles, fixed voltages are used to drive the device. When these electrodes on the cathode/gate plate can be used interchangeably as cathode or gate electrodes, respectively, pulse scanning method is used to drive the device.

9 Claims, 10 Drawing Sheets

DIELECTRIC-FREE TRIODE FIELD EMISSION DISPLAY DEVICE BASED ON DOUBLE-GATE/SINGLE-CATHODE TYPE ELECTRON EMISSION UNITS AND THE DEVICE DRIVE METHODS

TECHNICAL FIELD

This invention relates to display manufacturing technology, especially for a dielectric-free triode field emission display device based on double-gate/single-cathode type electron emission units and the device drive methods.

TECHNICAL BACKGROUND OF THE INVENTION

As a new type of flat panel displays, field emission display (FED) is a promising flat panel display following the liquid crystal display (LED) and plasma display panel (PDP). The FED has broad market prospect because of its high resolution, high contrast, wide viewing angle, fast response, high low temperature resistance, shock resistance, low radiation, low production costs, easy realization of digital display.

FED can be simply divided into diode-type and triode type FED according to its structure. The diode-type FED comprises cathode and anode. Electrons are emitted from the cathode under the control of anodic electric field and bombard the phosphor on the anode to emit light. The triod-type FED consists of cathode, gate and anode. Electrons are emitted from the cathode under the control of gate electric field and bombard the phosphor on the anode to realize luminescence.

The manufacturing process for diode-type FED is relatively simple, but high turn-on voltage is needed and uniformity of display is poor. Owing to the voltage limit in circuit, it is difficult to elevate the anode voltage, resulting in lower brightness and poor grayscale reproduction. Therefore, the diode-type FED has many limitations in applications. The triode-type FED, however, is widely used because of its good color purity, high brightness and low drive voltage.

The triode-type FED can be divided into the front-gate, back-gate and planar-gate types according to the position of gate electrode. Due to the small distance between the gate and cathode electrodes, the front-gate-type FED requires low gate voltage without the need high-voltage modulation on anode. But the fabrication process of front-gate structure is complex and it is difficult to achieve large area display as well as emission uniformity. The back-gate FED has a gate electrode buried under the cathode electrode. Electrons are emitted from the materials on the edges of cathodes utilizing the strong electric field between the gate and the cathode edge. However, as the cathode is exposed directly to the anodic electric field, anode voltage should not be too high, otherwise it will give rise to the diode-type emission. In addition, to avoid the crosstalk among the adjacent units, the distance between cathode and anode has to be decreased, which restrict the enhancement of anode voltage. Thus it prevents improving the luminous efficiency of phosphor. In the planar-gate FED, the cathode and gate electrodes are positioned parallelly on a faceplate. The electron emission materials are deposited on the cathodes and the spacing between cathode and gate electrodes is vacuum circumstance. The cathodes and gates can be fabricated simultaneously on the substrate using the normal exposure process and etching technology. In addition, the insulating layer in planar-gate FED is merely distributed in the cross point of the cathode-gate ranks scanning, and dose not influence the gate-controlled properties and electron emission performance. It greatly reduces the complexity and difficulty in manufacturing process. The planar-gate FED is the easiest triode structure to realize large area display because of the simple production process and the cost far less than that of front-gate and back-gate structures.

While there are a large number of patents concerning the structure of FED panel, the drive circuit designed for given structures is less proposed. The drive circuit is an important part of the FED display system, determining largely the performance of FED monitors.

SUMMARY OF THE INVENTION

The purpose of this invention is to provide a dielectric-free triode field emission display device based on double-gate/single-cathode type electron emission units and the device drive methods. This device needs simple manufacturing process and the drive methods are useful to improve the performance of the FED display device.

To achieve the purposes mentioned above, this invention provides a dielectric-free triode field emission display device based on double-gate/single-cathode type electron emission units comprising parallelly positioned anode and cathode/gate plates. It has characteristics as follows. The cathodes and gate electrodes are separately positioned on the cathode/gate plate with the repeat unit of gate/cathode/gate. A series of gate/cathode/gate electron emission units are arranged side by side on the cathode/gate plate and the spacing between cathode and gate electrodes is vacuum circumstance. Each anode on the anode faceplate faces correspondingly a cathode. The number of electron emission units is ⅓ of the sum of electrodes on the cathode/gate plate. The mentioned cathodes are fabricated with electron emission materials.

This invention provides a drive method based on the structure mentioned above. When the gate electrodes are disconnected, a high addressing voltage is applied on the anode and a drive method of tripotential fixed voltage is used to drive the cathode/gate plate. For a given electron emission unit, a negative voltage is applied on the central cathode and a positive voltage is applied on two adjacent gate electrodes on both sides of the cathode, while all the rest electrodes are with zero-voltage. Electrons are emitted from the central cathode of the electron emission unit mentioned above under the control of two adjacent gate electrodes and bombard the phosphor powder on the corresponding anode to emit light. According to this method, drive voltages are applied to the cathode and gate electrodes of each emission unit in turn to drive the cathode/gate plate repeatedly.

Based on this structure, this invention provides another drive method. When the gate electrodes are interconnected, a high addressing voltage is applied on the anode and a drive method of two-potential fixed voltage is used to drive the cathode/gate plate. For a given electron emission unit, a low voltage is applied on the central cathode and a high voltage is applied on all the rest cathode and gate electrodes. Electrons are emitted from the central cathode of the electron emission unit mentioned above under the control of two adjacent gate electrodes. According to this method, drive voltages are applied to the cathode and gate electrodes of each emission unit in turn to drive the cathode/gate plate repeatedly.

This invention also provides another dielectric-free triode field emission display device based on double-gate/single-cathode type electron emission units comprising parallelly positioned anode and cathode/gate plates. It has characteristics as follows. The cathodes and gate electrodes are separately positioned on the cathode/gate plate with the repeat unit of cathode/gate configuration, ending the distribution with gate electrode. A series of gate/cathode/gate electron emission units are arranged side by side on the cathode/gate plate and the adjacent electron emission unites share a gate electrode. The spacing between cathode and gate electrodes is vacuum circumstance. Each anode on the anode faceplate faces correspondingly a cathode. The number of electron emission units is ½ of the sum of electrodes on the cathode/gate plate. The mentioned cathodes are fabricated with electron emission materials.

Based on the second structure, this invention provides a drive method. When the gate electrodes are disconnected, a high addressing voltage is applied on the anode and a drive method of tripotential fixed voltage is used to drive the cathode/gate plate. For a given electron emission unit, a negative voltage is applied on the central cathode and a positive voltage is applied on two adjacent gate electrodes on both sides of the cathode, while all the rest electrodes are with zero-voltage. Electrons are emitted from the central cathode of the electron emission unit mentioned above under the control of two adjacent gate electrodes and bombard the phosphor powder on the corresponding anode to emit light. According to this method, drive voltages are applied to the cathode and gate electrodes of each emission unit in turn to drive the cathode/gate plate repeatedly.

Based on the second structure, this invention also provides another drive method. When the gate electrodes are interconnected, a high addressing voltage is applied on the anode and a drive method of two-potential fixed voltage is used to drive the cathode/gate plate. For a given electron emission unit, a low voltage is applied on the central cathode and high voltage are applied on all the rest cathode and gate electrodes. Electrons are emitted from the central cathode of the electron emission unit mentioned above under the control of two adjacent gate electrodes. According to this method, drive voltages are applied to the cathode and gate electrodes of each emission unit in turn to drive the cathode/gate plate repeatedly.

This invention also provides another dielectric-free triode field emission display device based on double-gate/single-cathode type electron emission units comprising parallelly positioned anode and cathode/gate plates. It has characteristics as follows. The cathode/gate plate consists of uniformly spaced electrodes that can be used interchangeably as the cathode and gate electrodes. All the electrodes are fabricated with or without electron emission materials and the electrode spacing is vacuum circumstance. Each anode on the anode faceplate faces correspondingly a cathode.

Based on the third structure, this invention provides a drive method. A high addressing voltage is applied on the anode and a drive method of tripotential pulse scanning is used to drive the cathode/gate plate. A negative voltage is applied on the electrode at position N as cathode, and two adjacent electrodes on both sides of the N electrode are with positive voltage as gate electrodes. These three electrodes compose an electron emission unit while all the rest electrodes are with zero-voltage. The cathode N mentioned above emits electrons under the control of two adjacent gate electrodes. According to this method, a negative voltage is applied on the electrode at position N+1, and two adjacent electrodes on both sides of the electrode N+1 are with positive voltage as gate electrodes. Thus another electron emission unit is formed when all the rest electrodes are with zero-voltage. This cycle repeats to drive the cathode/gate plate. So the number of electron emission units is two less than the sum of electrodes on the cathode/gate plate.

This invention also provides another drive method based on the third structure. A high addressing voltage is applied on the anode and a drive method of two-potential pulse scanning is used to drive the cathode/gate plate. A low voltage is applied on the electrode at position N as cathode, and two adjacent electrodes on both sides of the N electrode are with high voltage as gate electrodes. These three electrodes compose an electron emission unit while all the rest electrodes are with high voltage. The cathode N mentioned above emits electrons under the control of two adjacent gate electrodes. According to this method, a low voltage is applied on the electrode at position N+1 as cathode, and all the rest electrodes are with high voltage, forming another electron emission unit. This cycle repeats to drive the cathode/gate plate. So the number of electron emission units is two less than the sum of electrodes on the cathode/gate plate.

This invention has several merits. Since the cathode and gate electrodes are separately arranged on the cathode/gate plate with the spacing of vacuum circumstance, the dielectric layer to insulate the electrodes is not needed. It simplifies the manufacturing process of the FED device, thus reducing the fabrication difficulty. It also provides different configurations for a same type of electron emission unit. Furthermore, this invention provides corresponding drive methods. The voltage applied on cathode/gate plate is to scan and the voltage on the anode faceplate is to modulate the signal. When all the electrodes are designated as cathode or gate electrodes, a fixed voltage is used to drive the circuit. While a pulse canning method is used to drive the circuit when the electrodes can be interchanged between cathodes and gates. The drive methods improve the performance of the FED display.

DETAILED DESCRIPTION OF THE INVENTION

Figure 1:
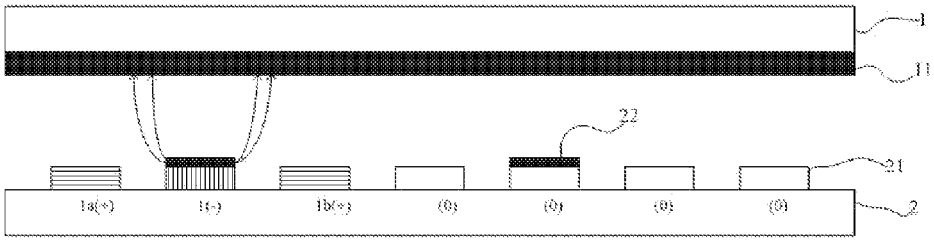
FIG. 1 and FIG. 2 are partial schematic configurations of disconnected gate devices with gate/cathode/gate repeat units at two consecutive moments.

This invention provides a dielectric-free triode field emission display device based on double-gate/single-cathode type electron emission units comprising parallelly positioned anode and cathode/gate plates. The cathodes and gate electrodes are separately positioned on the cathode/gate plate with the repeat unit of gate/cathode/gate. A series of gate/ cathode/gate electron emission units are arranged side by side on the cathode/gate plate and the spacing between cathode and gate electrodes is vacuum circumstance. Each anode on the anode faceplate faces correspondingly a cathode. The number of electron emission units is ⅓ of the sum of electrodes on the cathode/gate plate. The mentioned cathodes are fabricated with electron emission materials.

Based on the structure mentioned above, this invention provides a drive method. When the gate electrodes are disconnected, a high addressing voltage is applied on the anode and a drive method of tripotential fixed voltage is used to drive the cathode/gate plate. For a given electron emission unit, a negative voltage is applied on the central cathode and a positive voltage is applied on two adjacent gate electrodes on both sides of the cathode, while all the rest electrodes are with zero-voltage. Electrons are emitted from the central cathode of the electron emission unit mentioned above under the control of two adjacent gate electrodes and bombard the phosphor powder on the corresponding anode to emit light. According to this method, drive voltages are applied to the cathode and gate electrodes of each emission unit in turn to drive the cathode/gate plate repeatedly.

Based on this structure, this invention provides another drive method. When the gate electrodes are interconnected, a high addressing voltage is applied on the anode and a drive method of two-potential fixed voltage is used to drive the cathode/gate plate. For a given electron emission unit, a low voltage is applied on the central cathode and a high voltage is applied on all the rest cathode and gate electrodes. Electrons are emitted from the central cathode of the electron emission unit mentioned above under the control of two adjacent gate electrodes. According to this method, drive voltages are applied to the cathode and gate electrodes of each emission unit in turn to drive the cathode/gate plate repeatedly.

This invention provides a second program of dielectric-free triode field emission display device based on double-gate/single-cathode type electron emission units comprising parallelly positioned anode and cathode/gate plates. The cathodes and gate electrodes are separately positioned on the cathode/gate plate with the repeat unit of cathode/gate configuration, ending the distribution with gate electrode. A series of gate/cathode/gate electron emission units are arranged side by side on the cathode/gate plate and the adjacent electron emission unites share a gate electrode. The spacing between cathode and gate electrodes is vacuum circumstance. Each anode on the anode faceplate faces correspondingly a cathode. The number of electron emission units is ½ of the sum of electrodes on the cathode/gate plate. The mentioned cathodes are fabricated with electron emission materials.

Based on the second structure, this invention provides a drive method. When the gate electrodes are disconnected, a high addressing voltage is applied on the anode and a drive method of tripotential fixed voltage is used to drive the cathode/gate plate. For a given electron emission unit, a negative voltage is applied on the central cathode and a positive voltage is applied on two adjacent gate electrodes on both sides of the cathode, while all the rest electrodes are with zero-voltage. Electrons are emitted from the central cathode of the electron emission unit mentioned above under the control of two adjacent gate electrodes and bombard the phosphor powder on the corresponding anode to emit light. According to this method, drive voltages are applied to the cathode and gate electrodes of each emission unit in turn to drive the cathode/gate plate repeatedly.

Based on the second structure, this invention also provides another drive method. When the gate electrodes are interconnected, a high addressing voltage is applied on the anode and a drive method of two-potential fixed voltage is used to drive the cathode/gate plate. For a given electron emission unit, a low voltage is applied on the central cathode and high voltage are applied on all the rest cathode and gate electrodes. Electrons are emitted from the central cathode of the electron emission unit mentioned above under the control of two adjacent gate electrodes. According to this method, drive voltages are applied to the cathode and gate electrodes of each emission unit in turn to drive the cathode/gate plate repeatedly.

This invention also provides a third dielectric-free triode field emission display device based on double-gate/single-cathode type electron emission units comprising parallelly positioned anode and cathode/gate plates. The cathode/gate plate consists of uniformly spaced electrodes that can be used interchangeably as the cathode and gate electrodes. All the electrodes are fabricated with or without electron emission materials and the electrode spacing is vacuum circumstance. Each anode on the anode faceplate faces correspondingly a cathode.

Based on the third structure, this invention provides a drive method. A high addressing voltage is applied on the anode and a drive method of tripotential pulse scanning is used to drive the cathode/gate plate. A negative voltage is applied on the electrode at position N as cathode, and two adjacent electrodes on both sides of the N electrode are with positive voltage as gate electrodes. These three electrodes compose an electron emission unit while all the rest electrodes are with zero-voltage. The cathode mentioned above emits electrons under the control of gate electrodes. According to this method, a negative voltage is applied on the electrode at position N+1, and two adjacent electrodes on both sides of the electrode N+1 are with positive voltage as gate electrodes. Thus another electron emission unit is formed when all the rest electrodes are with zero-voltage. This cycle repeats to drive the cathode/gate plate. So the number of electron emission units is two less than the sum of electrodes on the cathode/gate plate.

This invention also provides another drive method based on the third structure. A high addressing voltage is applied on the anode and a drive method of two-potential pulse scanning is used to drive the cathode/gate plate. A low voltage is applied on the electrode at position N as cathode, and two adjacent electrodes on both sides of the electrode N are with high voltage as gate electrodes. These three electrodes compose an electron emission unit while all the rest electrodes are with low voltage. The cathode mentioned above emits electrons under the control of gate electrodes. According to this method, a low voltage is applied on the electrode at position N+1, and two adjacent electrodes on both sides of the electrode N+1 are with high voltage as gate electrodes. Thus another electron emission unit is formed when all the rest electrodes are with high voltage. This cycle repeats to drive the cathode/gate plate. So the number of electron emission units is two less than the sum of electrodes on the cathode/gate plate.

Details of this invention are further described considering the figures and embodiments.

Figure 2:
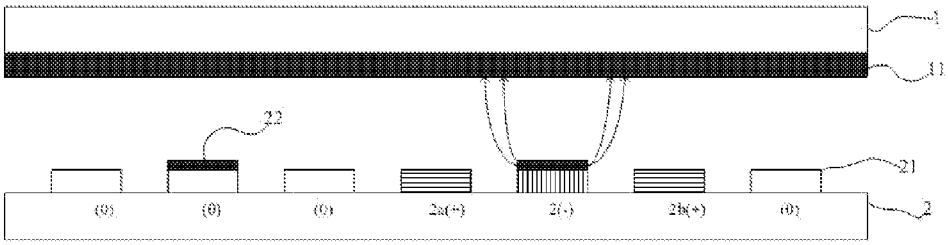
Figure 3:
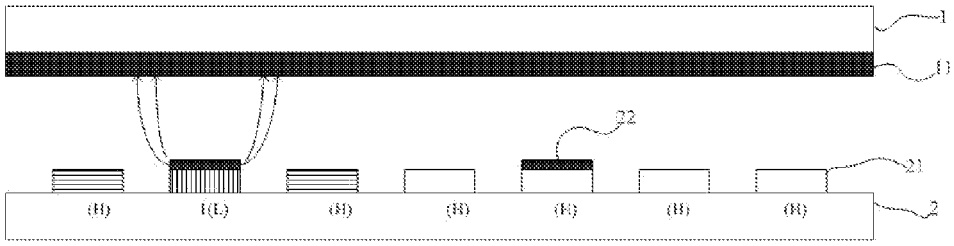
FIG. 3 and FIG. 4 are partial schematic configurations of interconnected gate device with gate/cathode/gate repeat units at two consecutive moments.
Figure 4:
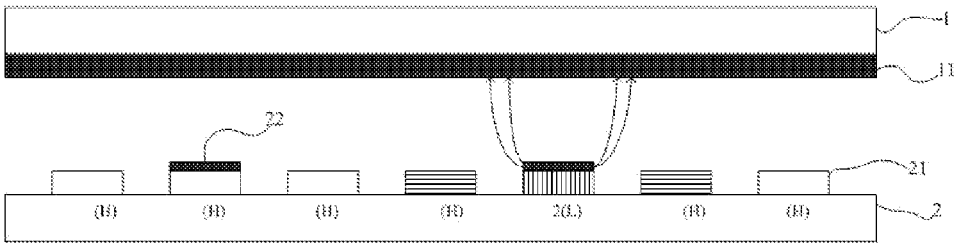
Figure 5:
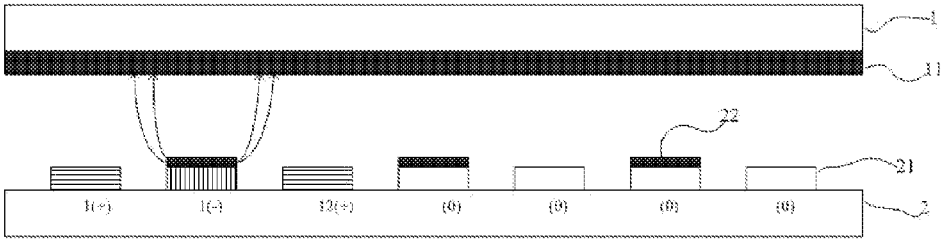
FIGS. 5, 6 and 7 are partial schematic configurations of disconnected gate devices with gate/cathode repeat units at three consecutive moments.
Figure 6:
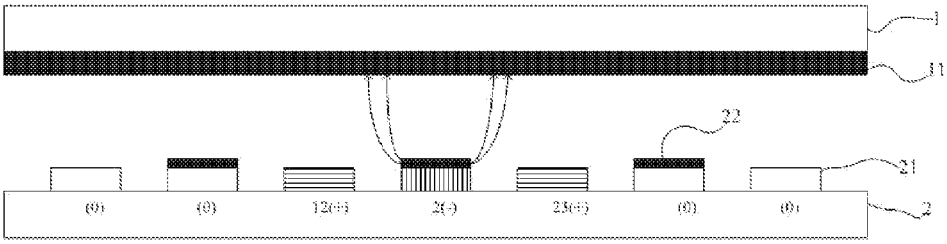
Figure 7:
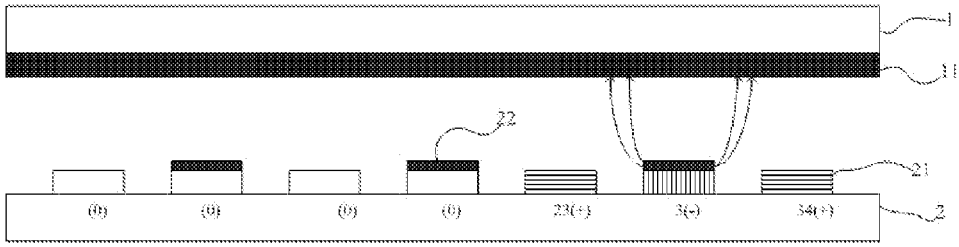
Figure 8:
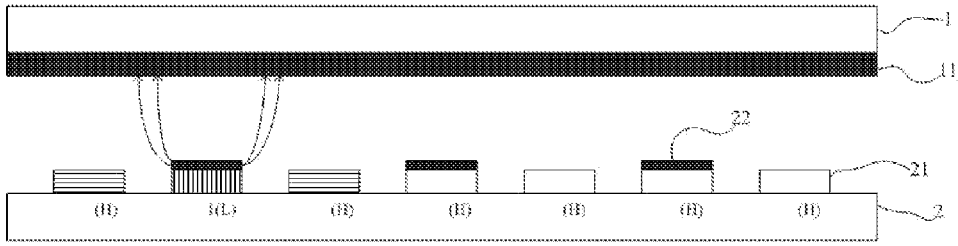
FIGS. 8, 9 and 10 are partial schematic configurations of interconnected gate device with gate/cathode repeat units with at three consecutive moments.
Figure 9:
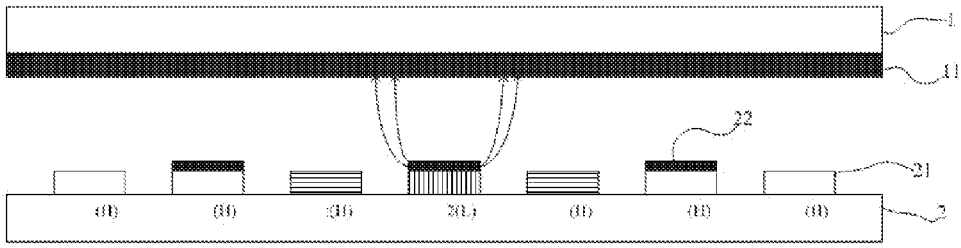
Figure 10:
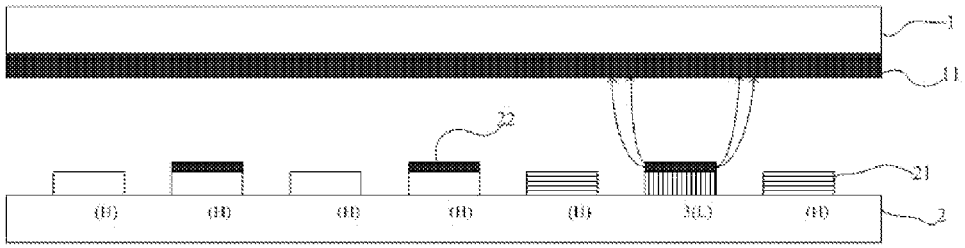
Figure 11:
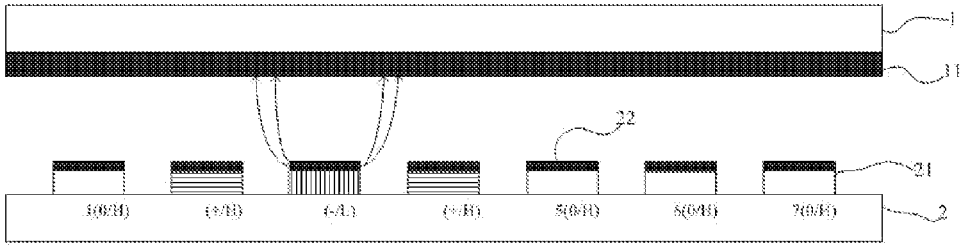
FIGS. 11, 12 and 13 are partial schematic configurations of device with interchangeable cathode and gate electrodes at three consecutive moments.
Figure 12:
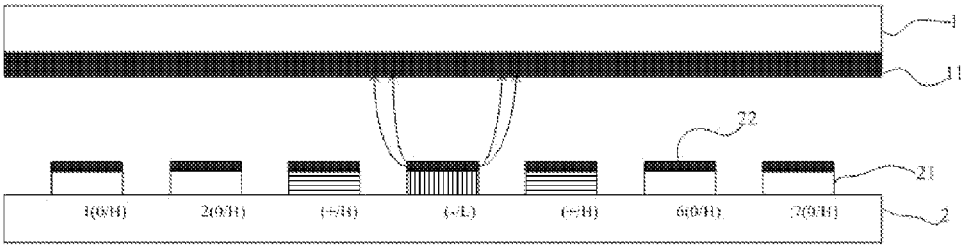
Figure 13:
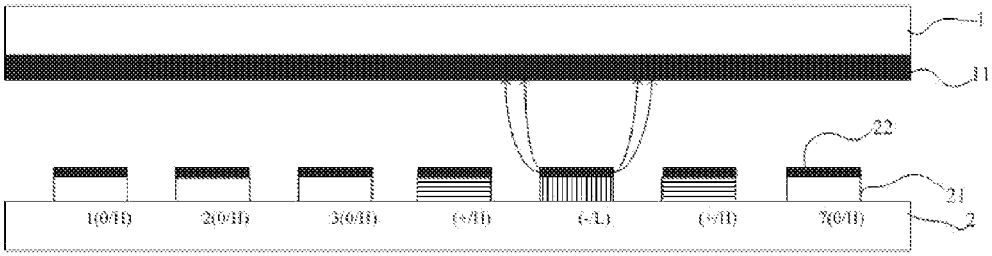

This invention provides a dielectric-free triode field emission display device based on double-gate/single-cathode type electron emission units comprising an anode faceplate 1 and a cathode/gate plate 2, as shown in FIGS. 1-13. Anode electrodes 12 are arranged separately on the anode faceplate 1, and electrodes 21 are parallelly distributed with a given spacing on the cathode/gate plate 2. Shown in FIG. 1-10 are the schematic configurations of device with designated cathodes and gates, where the cathodes are fabricated with electron emission materials 22 and the gate electrodes are fabricated without electron emission materials 22. FIGS. 1 and 2 are the schematic configuration of disconnected electrode device with gate/cathode/gate repeat units. FIGS. 3 and 4 are schematic configurations of interconnected electrode device with gate/cathode/gate repeat units. FIGS. 5, 6 and 7 are schematic configurations of disconnected electrode device with cathode/gate repeat units. FIGS. 8, 9 and 10 are schematic configurations of interconnected gate device with cathode/gate repeat units. FIGS. 11, 12 and 13 are schematic configurations of device with interchangeable cathode and gate electrodes, in which all the electrodes are fabricated with or without electron emission materials.

Based on the structures mentioned above, this invention provides corresponding drive methods. On the anode faceplate, a high addressing voltage is applied on the anodes. This voltage is higher than those applied on the cathode and gate electrodes, making the anodes collect electrons. Provided that the high low voltage is applied on the electron emission unit selected on the cathode/gate plate, a voltage difference exists between the selected and non-selected electrodes, leading to semi-bright. This problem is revealed out in this invention by using tripotential and two-potential drive method.

The tripotential drive method means that the cathode of the electron emission unit selected is with negative voltage $-V_k$, gate electrode with positive voltage $+V_g$ and all the rest electrodes with zero-voltage. There is a threshold voltage for electron emission between electrodes, i.e. electrons are emitted at a voltage difference between electrodes lower than the threshold voltage while electrons are not emitted at a voltage difference between electrodes higher than the threshold voltage. According to the above characteristics, the difference between the applied positive and negative voltages is larger than the threshold voltage, and the difference between positive voltage and zero-voltage, as well as the difference between negative voltage and zero-voltage, is lower than the threshold voltage. Therefore, it avoids the semi-bright problem.

The two-potential drive method merely uses high voltage HV and low voltage LV. The voltage applied on all the electrodes located on the left side of an electron emission unit selected is the same as that on its left electrode. Similarly, the voltage applied on all the electrodes located on the right side of the electron emission unit selected is the same as that on its right electrode. Since the voltage applied on the selected electrode is the same as those on the adjacent non-selected electrodes, it eliminates the problem of semi-bright caused by voltage difference.

Figure 14:
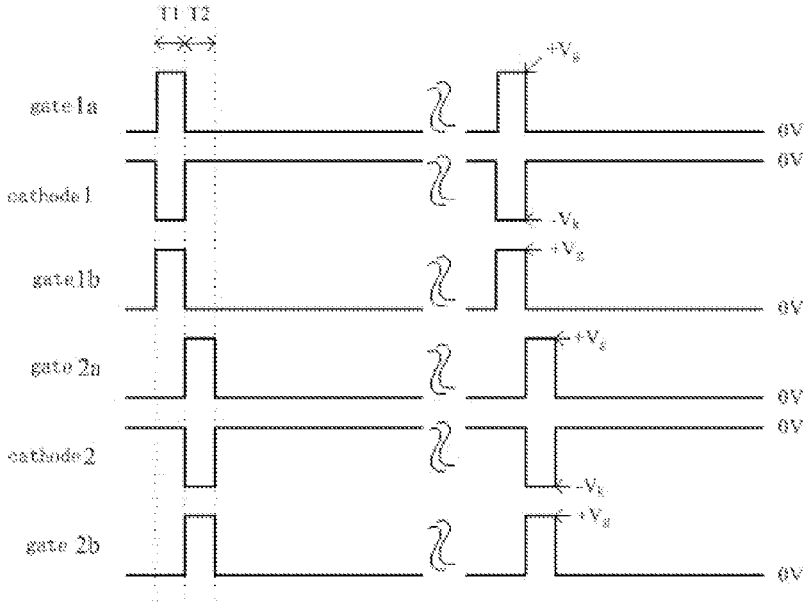
FIG. 14 is the sequence diagram of drive method for the devices as shown in FIGS. 1 and 2.

When the cathode/gate plate has a configuration like those in FIGS. 1 and 2, the tripotential drive method is used, as shown in FIG. 14. At time T1, the gate electrode 1*a* is with positive voltage $+V_g$, cathode 1 with negative voltage $-V_k$, and gate electrode 1*b* is with positive voltage $+V_g$, while all the rest electrodes are with zero-voltage, as shown in FIG. 1. These three electrodes compose a gate/cathode/gate electron emission unit, and electrons are emitted from cathode 1 under the control of gate electrodes 1*a* and 1*b* to bombard the phosphor on the anode faceplate. At time T2, the same positive and negative voltages are applied on another electron emission unit, as shown in FIG. 2. The cathode 2 emits electrons under the control of gate electrode 2*a* and 2*b*. This cycle repeats to drive the cathode/gate plate.

Figure 15:
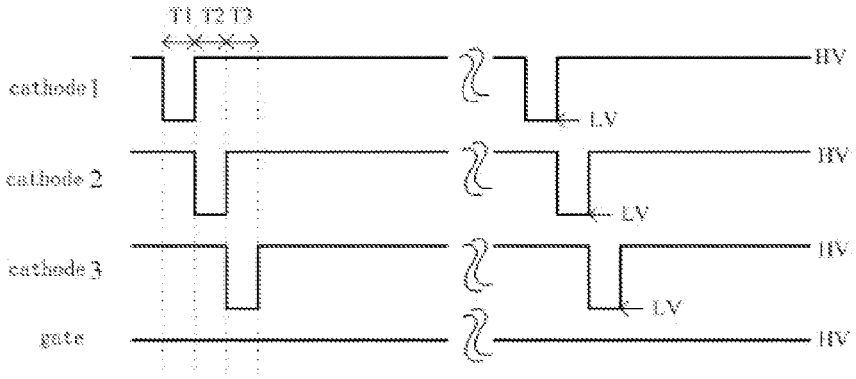
FIG. 15 is the sequence diagram of drive method for the devices as shown in FIGS. 3, 4, 8, 9 and 10.

When the cathode/gate plate has a configuration like those in FIGS. 3 and 4, the two-potential drive method is used, as shown in FIG. 15. The gate electrodes are with high voltage LV all the time. The cathode is with low voltage HV when it is selected and otherwise it is with high voltage LV. The structures at time T1 and T2 are shown in FIGS. 3 and 4, respectively. Electrons are emitted from the cathode under the control of two adjacent gate electrodes.

Figure 16:
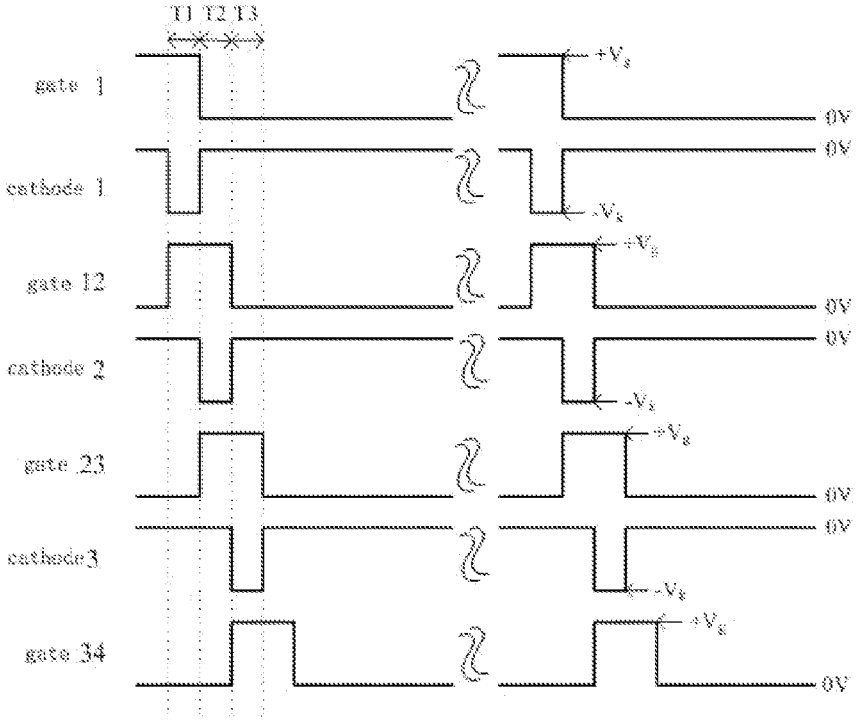
FIG. 16 is the sequence diagram of drive method for the devices as shown in FIGS. 5, 6 and 7.

When the cathode/gate plate has a configuration like those in FIGS. 5, 6 and 7, the tripotential drive method is used, as shown in FIG. 16. At time T1, the gate electrode 1 is with positive voltage $+V_g$, the cathode 1 with negative voltage $-V_k$, the gate electrode 12 with positive voltage $+V_g$, while all the rest electrodes are with zero-voltage, as shown in FIG. 5. These three electrodes compose a gate/cathode/gate electron emission unit, and electrons are emitted from cathode 1 under the control of gate electrodes 1 and 12 to bombard the phosphor on the anode faceplate. At time T2, the gate electrode 12 is with positive voltage $+V_g$, the cathode 2 with negative voltage $-V_k$, the gate electrode 23 with positive voltage $+V_g$, as shown in FIG. 6. These three electrodes compose a gate/cathode/gate electron emission unit, and electrons are emitted from cathode 2 under the control of gate electrodes 12 and 23 to bombard the phosphor on the anode faceplate. At time T3, the voltages are likewise applied on gate electrode 23, cathode 3 and gate electrode 34, as shown in FIG. 7. This cycle repeats to drive the cathode/gate plate.

When the cathode/gate plate has a configuration like those in FIGS. 8, 9 and 10, the two-potential drive method is used, as shown in FIG. 15. The gate electrodes are with high voltage HV all the time. The cathode is with low voltage LV when it is selected and otherwise it is with high voltage HV. The structures at time T1, T2 and T3 are shown in FIGS. 8, 9 and 10, respectively. Electrons are emitted from the cathode under the control of two gate electrodes.

Figure 17:
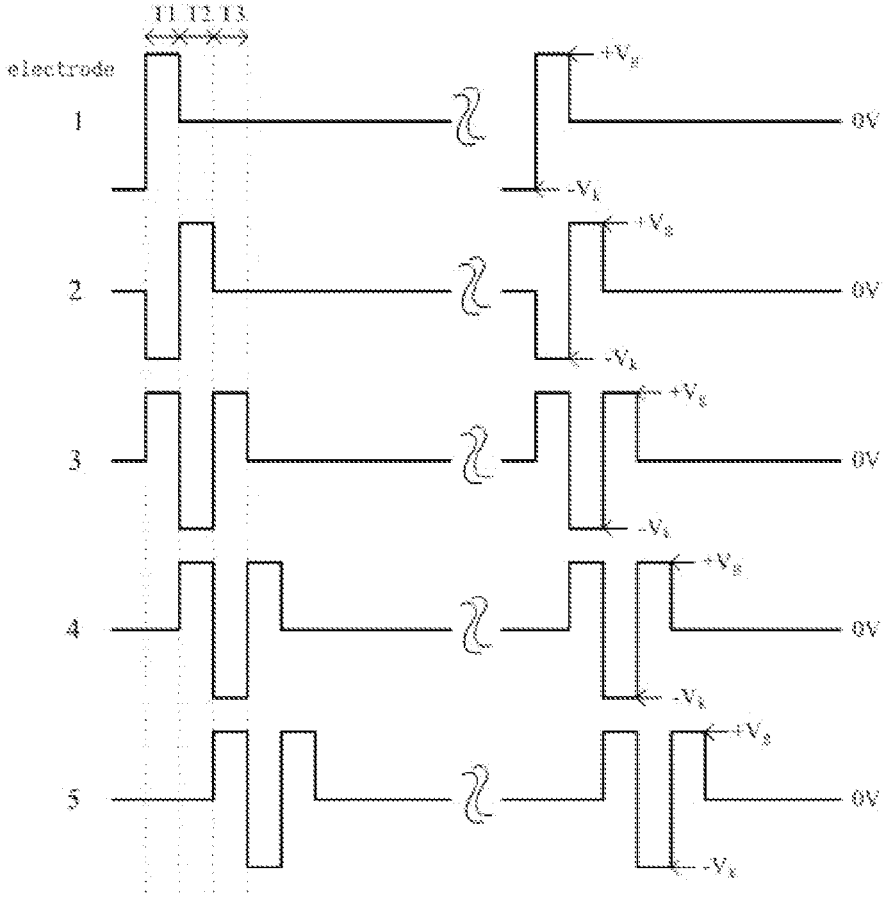
FIG. 17 is the sequence diagram of tripotential drive method for the device with interchangeable cathode and gate electrodes.
Figure 18:
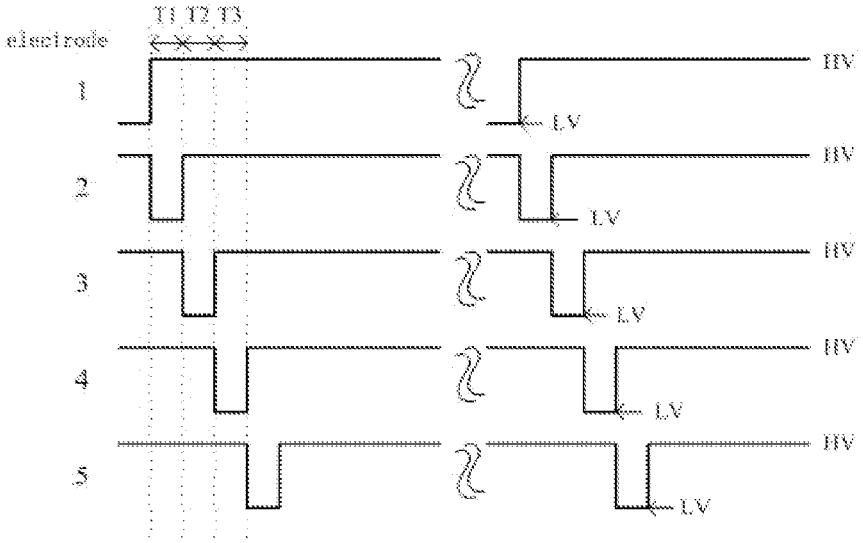
FIG. 18 is the sequence diagram of two-potential drive method for the device with interchangeable cathode and gate electrodes.

When the cathode/gate plate has a configuration like those in FIGS. 11, 12 and 13, the drive method is described as below. FIG. 17 is the sequence diagram of tripotential drive method. Five adjacent electrodes are labeled from electrode 1 to electrode 5. At time T1, the electrode 1 is with positive voltage $+V_g$, the electrode 2 with negative voltage $-V_k$, the electrode 3 with positive voltage $+V_g$, while all the rest electrodes are with zero-voltage, as shown in FIG. 11. The electrode 2 is used as cathode and electrodes 1 and 3 as gate electrodes. These three electrodes compose a gate/cathode/gate electron emission unit, and electrons are emitted from the electrode 2 under the control of electrodes 1 and 3. At time T2, the electrode 2 is with positive voltage $+V_g$, the electrode 3 with negative voltage $-V_k$, the electrode 4 with positive voltage $+V_k$, while all the rest electrodes are with zero-voltage, as shown in FIG. 12. The electrode 3 is used as cathode and electrode 2 and 4 as gate electrodes, forming another gate/cathode/gate electron emission unit. At time T3, the electrode 3 is with positive voltage $+V_g$, the electrode 4 with negative voltage $-V_k$, the electrode 5 with positive voltage $+V_g$, as shown in FIG. 13. This cycle repeats to drive the cathode/gate plate without reducing the resolution. FIG. 18 is the sequence diagram of two-potential drive method. Five adjacent electrodes are labeled from electrode 1 to electrode 5. At time T1, the electrode 1 is with high voltage HV, the electrode 2 with low voltage LV, the electrode 3 with high voltage HV, while all the rest electrodes are with high voltage HV, as shown in FIG. 11. The electrode 2 is used as cathode and electrode 1 and 3 as gate electrodes. These three electrodes compose a gate/cathode/gate electron emission unit, and electrons are emitted from electrodes 2 under the control of electrode 1 and 3. At time T2, the electrode 2 is with high voltage HV, the electrode 3 with low voltage LV, the electrode 4 with high voltage HV, while all the rest electrodes are with high voltage HV, as shown in FIG. 12. The electrode 3 is used as cathode and electrode 2 and 4 as gate electrodes. These three electrodes compose another gate/cathode/gate electron emission unit. At time T3, the electrode 3 is with high voltage HV, the electrode 4 with low voltage LV, the electrode 5 with high voltage HV, as shown in FIG. 13. This cycle repeats to drive the cathode/gate plate without reducing the resolution.

Although the present invention has been described with respect to the foregoing preferred embodiments, it should be understood that various other changes, omissions and deviations in the form and detail thereof may be made without departing from the scope of this invention.

What is claimed is:

1. A dielectric-free triode field emission display device based on double-gate/single-cathode type electron emission units, comprising an anode faceplate and a cathode/gate plate which is positioned parallel to the anode faceplate mentioned above, wherein two gate electrodes positioned adjacent and spaced apart from a cathode electrode so the gate/cathode/gate configuration is a repeat unit; a plurality of gate/cathode/gate electron emission units arranged side by side on the cathode/gate plate; a space between cathode and gate electrodes having vacuum circumstance; a plurality of cathode electrodes fabricated with electron emission materials; an anode on the anode faceplate facing a cathode.

2. The dielectric-free triode field emission display device based on double-gate/single-cathode type electron emission units according to claim 1, wherein as the gate electrodes disconnected, a high addressing voltage is applied on the anode and a drive method of tripotential fixed voltage is used to drive the cathode/gate plate; and for a given electron emission unit, a negative voltage being applied on a central cathode and positive voltage being applied on two adjacent gate electrodes on both sides of the cathode, while all the rest electrodes having zero-voltage; electrons being emitted from a central cathodes of said electron emission unit under the control of two adjacent gate electrodes and bombard the phosphor powder on the corresponding anode; and drive voltages being applied to the cathode and gate electrodes of each emission unit in turn to drive the cathode/gate plate repeatedly.

3. The dielectric-free triode field emission display device based on double-gate/single-cathode type electron emission units according to claim 1, wherein as the gate electrodes interconnected, a high addressing voltage is applied on the anode and a drive method of two-potential fixed voltage is used to drive the cathode/gate plate; for a given electron emission unit, a low voltage being applied on a central cathode and high voltage being applied on all the rest cathode and gate electrodes; electrons being emitted from the central cathode of the electron emission unit mentioned above under the control of two adjacent gate electrodes and bombard the phosphor powder on the corresponding anode; and drive voltages being applied to the cathode and gate electrodes of each emission unit in turn to drive the cathode/gate plate repeatedly.

4. A dielectric-free triode field emission display device based on double-gate/single-cathode type electron emission units, comprising an anode faceplate and a cathode/gate plate which is positioned parallel to the anode faceplate mentioned above, wherein the gate electrodes positioned adjacent and spaced apart from the cathode electrode so the cathode/gate configuration is a repeat unit; the electrode distribution is terminated with gate electrodes on both sides; a plurality of gate/cathode/gate electron emission units arranged side by side on the cathode/gate plate; the adjacent electron emission unites share a gate electrode; a space between cathode and gate electrodes having vacuum circumstance; a plurality of cathode electrodes fabricated with electron emission materials; an anode on the anode faceplate facing a cathode.

5. The dielectric-free triode field emission display device based on double-gate/single-cathode type electron emission units according to claim 4, wherein as the gate electrodes disconnected, a high addressing voltage is applied on the anode and a drive method of tripotential fixed voltage being used to drive the cathode/gate plate; for a given electron emission unit, a negative voltage being applied on a central cathode and a positive voltage being applied on two adjacent gate electrodes on both sides of the cathode, while all the rest electrodes having zero-voltage; electrons being emitted from the central cathodes of the electron emission unit mentioned above under the control of two adjacent gate electrodes and bombard the phosphor powder on the corresponding anode; and drive voltages being applied to the cathode and gate electrodes of each emission unit in turn to drive the cathode/gate plate repeatedly.

6. The dielectric-free triode field emission display device based on double-gate/single-cathode type electron emission units according to claim 4, wherein as the gate electrodes interconnected, a high addressing voltage is applied on the anode and a drive method of two-potential fixed voltage is used to drive the cathode/gate plate; for a given electron emission unit, a low voltage being applied on a central cathode and high voltage being applied on all the rest cathode and gate electrodes; electrons being emitted from the cathode of the electron emission unit mentioned above under the control of two adjacent gate electrodes and bombard the phosphor powder on the corresponding anode; and drive voltages being applied to the cathode and gate electrodes of each emission unit in turn to drive the cathode/gate plate repeatedly.

7. A dielectric-free triode field emission display device based on double-gate/single-cathode type electron emission units, comprising an anode faceplate and a cathode/gate plate which is positioned parallel to the anode faceplate mentioned above, wherein a cathode/gate plate having uniformly spaced electrodes that can be used interchangeably as the cathode and gate electrodes; a space between cathode and gate electrodes having vacuum circumstance; a plurality of electrodes fabricated with or without electron emission materials; an anode on the anode faceplate facing a cathode.

8. The dielectric-free triode field emission display device based on double-gate/single-cathode type electron emission units according to claim 7, wherein a high addressing voltage is applied on the anode and a drive method of tripotential pulse scanning is used to drive the cathode/gate plate; a negative voltage being applied on the electrode at position N, and two adjacent electrodes on both sides of the N electrode having positive voltage as gate cathodes; these three electrodes composing an electron emission unit; all the rest electrodes having zero-voltage; the cathode mentioned above emitting electrons under the control of two adjacent gate electrodes; a negative voltage being applied on the electrode at position N+1, and two adjacent electrodes on both sides of the electrode N+1 having positive voltage as cathodes; so another electron emission unit being formed when all the rest electrodes having zero-voltage; and this cycle repeating to drive the cathode/gate plate.

9. The dielectric-free triode field emission display device based on double-gate/single-cathode type electron emission units according to claim 7, wherein a high addressing voltage is applied on the anode and a drive method of two-potential pulse scanning is used to drive the cathode/gate plate; a low voltage being applied on the electrode at position N, and two adjacent electrodes on both sides of the N electrode having high voltage as gate electrodes; these three electrodes composing an electron emission unit; all the rest electrodes having high voltage; the cathode mentioned above emitting electrons under the control of two adjacent gate electrodes; a low voltage being applied on the electrode at position N+1, and two adjacent electrodes on both sides of the electrode N+1 having high voltage as gate cathodes; so another electron emission unit being formed when all the rest electrodes having high voltage; and this cycle repeating to drive the cathode/gate plate.

* * * * *